US006131905A

United States Patent [19]

Christian

[11] Patent Number: 6,131,905

[45] Date of Patent: Oct. 17, 2000

[54] DISKS AND MAGNET GAME

[76] Inventor: Walter T. Christian, 16335 Orchard Grass La., Parker, Colo. 80134

[21] Appl. No.: 09/317,756

[22] Filed: May 24, 1999

[51] Int. Cl.[7] ..... A63F 3/00

[52] U.S. Cl. ..... 273/126 A

[58] Field of Search ..... 273/126 R, 126 A, 273/108, 118 R, 118 A

[56] References Cited

U.S. PATENT DOCUMENTS

| | | | |
|---|---|---|---|
| 3,764,144 | 10/1973 | Arthur | 273/126 A |
| 3,834,707 | 9/1974 | Birkett | 273/126 A |
| 3,870,308 | 3/1975 | Reilly | 273/126 A |
| 5,039,099 | 8/1991 | Bravo | 273/126 A |

*Primary Examiner*—Raleigh W. Chiu

*Attorney, Agent, or Firm*—Ramon L. Pizarro; Edwin H. Crabtree

[57] ABSTRACT

A game in which players compete to become the player who tosses the closest marker at a center piece without contacting the centerpiece. The components of the game include an opaque container serving as the centerpiece, the container having an outer surface and an inner cavity. A magnet that is smaller than the inner cavity of the container is held within the inner cavity of the container, such that the magnet may move within the container while its position within the container is concealed by the opaque qualities of the container. Additionally, disks which are of a material that is attracted to the magnet are provided for tossing, so that the disks can be slid towards the container the disks experience varying strength of attraction from the magnet depending on the direction of approach towards the container.

18 Claims, 2 Drawing Sheets

DISKS AND MAGNET GAME

BACKGROUND OF THE INVENTION (a) Field of the Invention

This invention generally relates to a game which uses a concealed magnet and several ferrous or magnetic disks. More particularly, but not by way of limitation, to a game that includes a magnet that is concealed within a case and which can moved within the case. The game also includes at least one ferrous or magnetic coin which can be slid towards the case holding the magnet. The object of the game being sliding the coin as close as possible to the case.

(b) Known Art

The game of shuffle-board has long been a popular game because it involves physical coordination and mental visualization of the outcome of collisions between the game pieces. Similarly, the classic games played with marbles provide hours of entertainment because they allow the player to use his physical abilities and coordination in casting the marbles, and use his mental abilities in that he has to visualize and calculate the reactions of the colliding marbles in order to properly execute a play.

Games of the type described are amusing, but can become boring to those who acquire significant skill in calculating the toss of the game pieces. Thus, there remains a need for a game which allows the player to use his physical abilities in tossing a game piece, use his mental skills in calculating reactions in colliding bodies, and involve chance and interpretation of clues.

Still further, there remains a need for a game that induces an aspect of unpredictability to intrigue and challenge even highly skilled players.

SUMMARY

It has been discovered that the problems left unanswered by known warning systems can be solved by providing a magnet and discs game which includes:

1) an opaque container having an outer surface and an inner cavity;
2) a magnet that is smaller than the inner cavity of the container; and
3) disks which are attracted to the magnet.

According to a highly preferred embodiment of the invention, the magnet will be completely concealed by the container, so that the exact position of the magnet within the container will not be ascertainable by looking at the container. Additionally, the disks will include indicia to allow players to keep track of the disks that belong to them or to their opponents.

To play a game with the above components, one player first shakes and then places the container with the magnet on to a smooth, flat surface. Preferably, the container will be generally disk shaped, with a round perimeter and flat top and bottom. This shape of the container will allow the user slide the container over the smooth, flat playing surface to a desired location on the surface where the container will rest on its flat top or bottom. Then each of the players will toss or slide a disk towards the container. The object of the game being sliding a disk towards the container.

Because the container will house a magnet that is smaller than the size of the inner cavity of the container, the players will not know the exact location of the magnet within the container. Therefore, players will toss, and preferably slide, the disks towards the container with the hope of having their disk approach the container from a direction which turns out to be closest to the concealed magnet. Approaching the container from a location that is closest to the concealed magnet will give the player the greatest chance to have his disk end up as the closest disk next to the container.

Still further, significant unexpected results have been discovered through the use of the disclosed game. It has been discovered that the use of a container with a rounded perimeter causes the disks to round the container when slid towards the container at the appropriate speed and from the appropriate direction. Thus, the players can gain clues as to the location of the magnet within the container by observing the reaction of the disks as they approach the container. Consequently, the cooperation of the magnet, container, and disks results in particularly amusing game of skill and chance.

Still further, once a disk contacts the container at a location close to the concealed magnet, the disk will assume magnetic properties which originate from the concealed magnet. Thus, as disks are slid towards the container, some disks will become attracted to disks which will already be attached to the container, producing a chain of disks attached to one another.

Additionally, it is important to note that it is contemplated that the game can be played by varying the objects of the game. For example, it is contemplated that in one method of play the object of the game will be to get the disks as close as possible to the container without actually contacting the container with the disk. Another variation on the object of the game would be to slide the disk towards the container and the player who gets the disk to round the container wins points.

Thus, it should be understood that while the above and other advantages, objects and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

Figure 5:
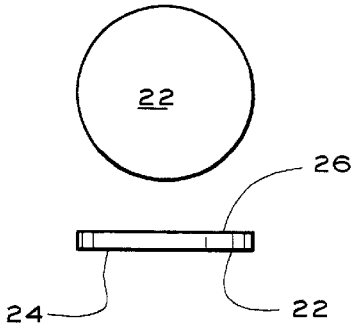

FIG. 5 includes a plan view and a side view of one of the disks used with the disclosed invention.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
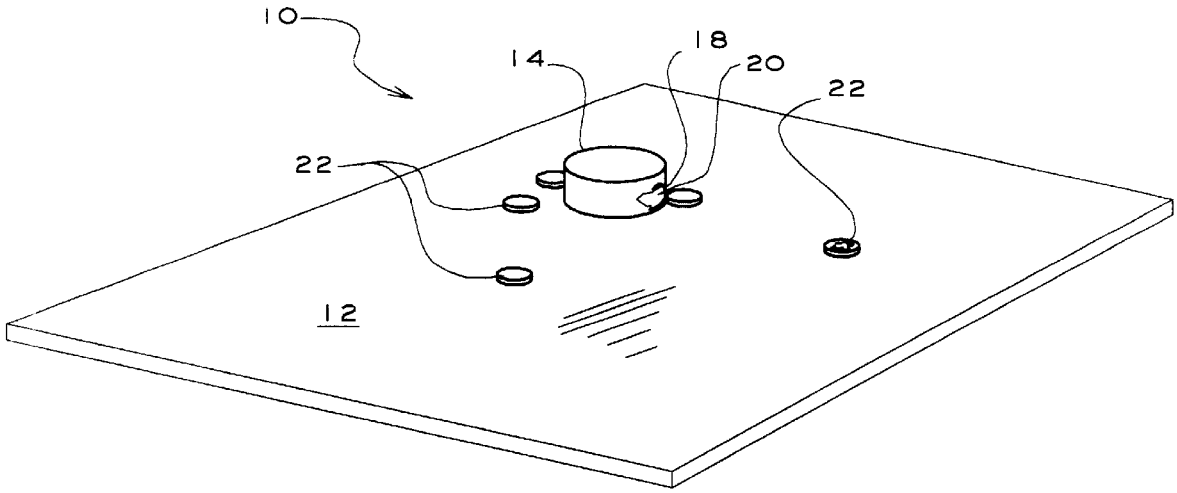
FIG. 1 is a perspective view of the game while in play.

Turning now to FIG. 1 where a game 10 made in accordance with the principles disclosed herein has been illustrated while being played over flat, generally smooth surface 12, such as a table top. It is contemplated that an object of the game 10 when played by several players would be to have the individual players compete in trying to become the player who tosses the closest marker to a center piece without contacting the centerpiece. Thus, in the illustrated embodiment an opaque cylindrical container 14 is used as the centerpiece which serves as the target for the markers being tossed.

Figure 2:
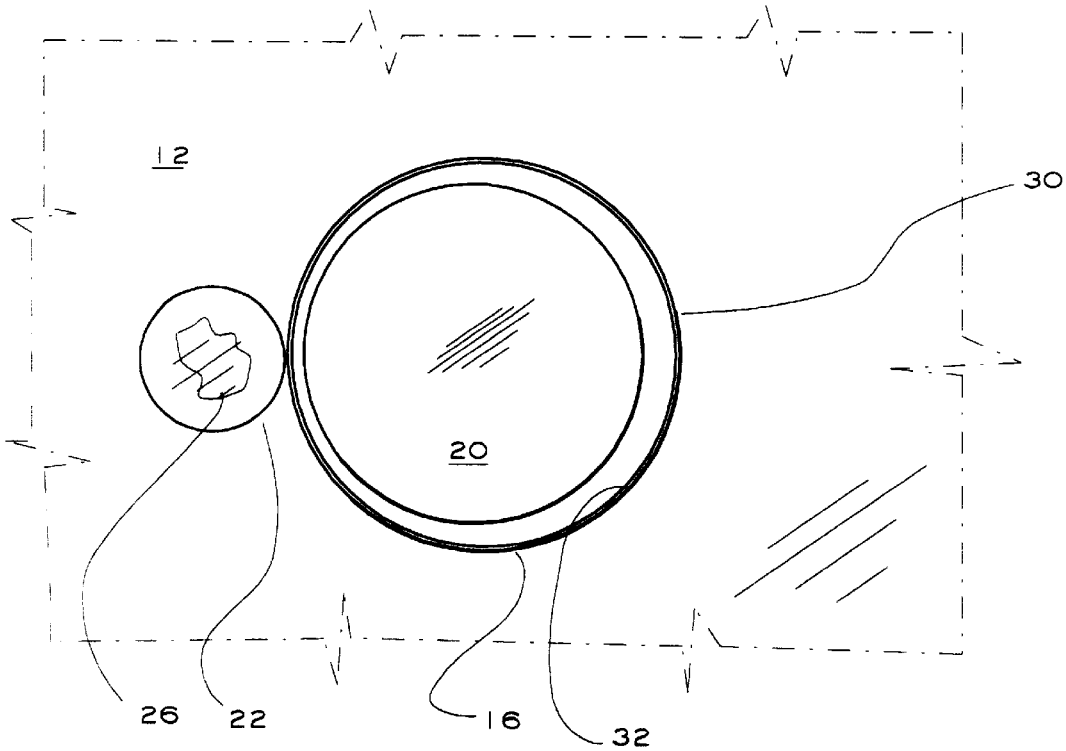
FIG. 2 is a plan view illustrating the container and one possible position of the magnet within the container.

Turning now to FIG. 2 it will be understood that according to a highly preferred embodiment of the invention the container 14 has an outer surface 16 and a cylindrical inner cavity 18. The cylindrical inner cavity 18 has been adapted for receiving a cylindrically shaped magnet 20 that is smaller than the inner cavity 18 of the container 14. According to a highly preferred embodiment of the invention, the magnet 20 will be free to move within the cavity 18 of the container 14. Thus, it contemplated that the dimension s of the magnet 20 will be such that the magnet 20 will be loosely retained within the cavity 18 of the container 12. This arrangement will allow a player to shake and reposition the magnet 20 within the container 12 such that other players will not know the position of the magnet within the container 14 due to the fact that the position of the magnet 20 within the container 14 is concealed by the opaque qualities of the container 14. Also, it is important to note that it is contemplated that the shape as well as the strength of the magnet 20 may be varied to achieve varying magnetic fields or fields with varying levels of strength around the perimeter of the container 12.

According to a highly preferred embodiment of the invention the, the markers used to play the game are disks 22 which are of a material that is attracted to the magnet. While it is contemplated that the discs will be made of a ferrous material, it is also contemplated that the discs may be made of a plastic material with a ferrous or magnetic filling, or simply of a magnetic material. Furthermore, it is contemplated that the disks 22 will include at least one smooth surface 24 that will allow the disks to be slid over the surface 12. Also, it is contemplated that another surface 26 of the disks 22 may incorporate indicia, such as logos, action characters, and so on. The indicia will serve to allow the individual players to keep track of their markers or disks 22.

Figure 3:
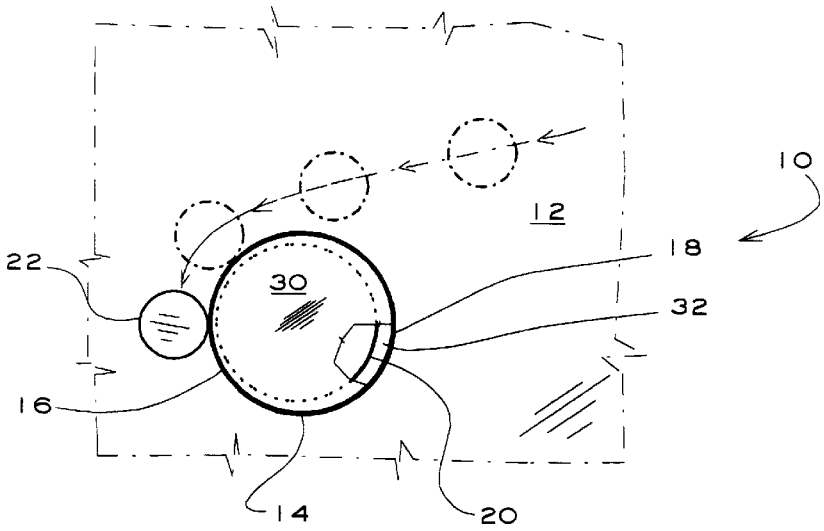
FIG. 3 is a plan view illustrating the play of the game, and specifically, the play while a disk rounds the container.

According to one contemplated method of play, the container with the magnet 20 will be shaken to allow the magnet 20 to reposition itself within the cavity 18 of the container 14. Then the container is slid or positioned on the surface 12 at a distance from the players. Then, the players will slide their disks towards the container as shown on FIG. 3. As the disk 22 approaches the container 14 it may come close to the concealed magnet 20, which would attract the disk and cause it to collide with the container 14 and travel around the container towards the location where the magnet 20 is closest to the outer surface 16 of the container 14. This "rounding" of the container by the disk provides clues as to the location of the concealed magnet and the strength of the concealed magnet 20. The player would then use observations about the "rounding" effect to calculate the force and direction of tossing of the next disc 22 to be tossed.

Figure 4:
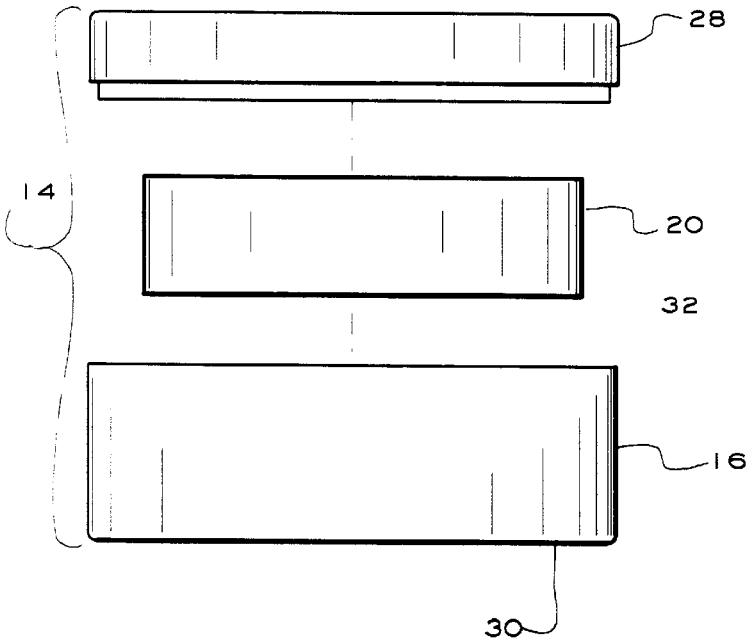
FIG. 4 shows an exploded view of an embodiment of the container and the magnet.

Turning now to FIG. 4, it will be understood that it is contemplated that the container 14 will be constructed with an access door or removable cover 28. This removable cover 28 will allow a user to change the magnet 20 in order to vary the size and strength of the magnet 20. By varying the size and strength of the magnet 20 one another variable which prevents the game from becoming boring to the players.

It is also important to note that, as shown on FIG. 4, it is contemplated that the container 14, in addition to being opaque, will be of a generally cylindrical shape. With a rounded cylindrical exterior surface 30 and a round, cylindrical interior surface 32. Also, the container 14 will include a generally flat top 34, or end, having a smooth surface, and a generally flat bottom 36, or end, having a smooth surface so that the container may be slid out to a desired location on the surface 12.

Turning now to FIG. 5 it will be understood that it is contemplated that the discs 22 include a flat, generally smooth surface 24 as well as a surface 25 that will accommodate or display include indicia 26.

In operation, the game 10 would be used for entertaining players who will be competing to become the player who tosses a marker closer to a center piece, without contacting the centerpiece, or who caused his disc to "round" the container 14. The game would played by having the individual players slide discs towards the container. Points would be awarded for coming close to the container without actually contacting the container, for knocking other player's markers away, or for forming strings of magnetically connected discs, starting with a disc which initially "rounded" the container 14.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A game for allowing players to compete to become the player who tosses the closest marker to a center piece without contacting the centerpiece, the game comprising:

an opaque container serving as the centerpiece, the container having an outer surface and an inner cavity;

a magnet that is smaller than the inner cavity of the container, the magnet being held within the inner cavity of said container such that the magnet may move within the container while its position within the container is concealed by the opaque qualities of said container; and disks which are of a material that is attracted to the magnet, so that the disks can be slid towards the container the disks experience varying strength of attraction from the magnet depending on the direction of approach towards the container.

2. A game according to claim 1 wherein said container includes a generally cylindrical shape consisting of cylindrical sides and flat ends.

3. A game according to claim 2 wherein the inner cavity of said container is generally cylindrical.

4. A game according to claim 3 wherein said magnet includes a cylindrical outer surface and flat ends, so that a portion of the cylindrical sides of the magnet is always closer to the cylindrical sides of the container when the magnet is not centered in the inner cavity of the container.

5. A game according to claim 1 wherein said disks are of a ferrous material.

6. A game according to claim 1 wherein said inner cavity includes a round surface and said magnet includes a round surface, so that the rounded surfaces of the magnet contact the rounded surfaces of the inner cavity along a line or point.

7. A game for players to compete in becoming the player who tosses the closest marker to a center piece without contacting is the centerpiece, the game comprising:

an opaque cylindrical container serving as the centerpiece, the container having an outer surface and a cylindrical inner cavity;

a cylindrically shaped magnet that is smaller than the inner cavity of the container, the magnet being loosely retained within the cavity of the container, such that the magnet may move within the container while its position within the container is concealed by the opaque qualities of the container; and disks which are of a material that is attracted to the magnet, so that the disks can be slid towards the container the disks experience varying strength of attraction from the magnet depending on the direction of approach towards the container.

8. A game according to claim 7 wherein said container includes a flat ends of a smooth material.

9. A game according to claim 8 wherein said container includes a removable cover for allowing a user to change the magnet, so that the magnet used to play the game can be varied to prevent play from becoming predictable.

10. A game according to claim 7 wherein said discs include indicia.

11. A game according to claim 7 wherein said disks are of a ferrous material.

12. A method for entertaining players by competing to become the player who tosses a marker closer to a center piece, without contacting the centerpiece, than a marker tossed by another player, the method comprising:

providing an opaque container serving as the centerpiece, the container having an outer surface and an inner cavity;

filling part of the inner cavity of the container with a magnet that remains loose within the inner cavity of the container, the magnet being held within said container such that the magnet may move within the container while its position within the container is concealed by the opaque qualities of said container;

providing a plurality or disks which are of a material that is attracted to the magnet, the disks having a smooth surface; and sliding the disks can be slid towards the container, so that the disks experience varying strength of attraction from the magnet depending on the direction of approach towards the container and so that the proximity of the disks relative to the container depends on the direction of approach of the sliding of the disks towards the container.

13. A method according to claim 12 wherein said container includes a generally cylindrical shape consisting of cylindrical sides and flat ends.

14. A method according to claim 12 wherein the inner cavity of said container is generally cylindrical.

15. A method according to claim 13 wherein said magnet includes a cylindrical outer surface and flat ends, so that a portion of the cylindrical sides of the magnet is always closer to the cylindrical sides of the container when the magnet is not centered in the inner cavity of the container.

16. A game according to claim 12 wherein said disks are of a ferrous material.

17. A method according to claim 12 wherein said inner cavity includes a round surface and said magnet includes a round surface, so that the rounded surfaces of the magnet contact the rounded surfaces of the inner cavity along a line or point.

18. A method according to claim 12 wherein said discs include one side having indicia and one smooth surface.

* * * * *